US009114321B1

(12) United States Patent
Myers

(10) Patent No.: US 9,114,321 B1
(45) Date of Patent: Aug. 25, 2015

(54) MECHANICAL RIDE SIMULATOR

(71) Applicant: Gracienne Myers, Port Matilda, PA (US)

(72) Inventor: Gracienne Myers, Port Matilda, PA (US)

( * ) Notice: Subject to any disclaimer, the term of this patent is extended or adjusted under 35 U.S.C. 154(b) by 0 days.

(21) Appl. No.: 14/068,211

(22) Filed: Oct. 31, 2013

Related U.S. Application Data

(60) Provisional application No. 61/721,157, filed on Nov. 1, 2012.

(51) Int. Cl.
*A63G 19/20* (2006.01)
*A63G 13/00* (2006.01)

(52) U.S. Cl.
CPC ..... *A63G 19/20* (2013.01)

(58) Field of Classification Search
CPC ..... A63G 13/00; A63G 13/08; A63G 19/02; A63B 22/001; A63B 26/003; A63B 69/00; A63B 69/04; A63B 2244/24; A61H 2201/1215; A61H 2201/163; A61H 2201/0406; A61H 2201/0431
USPC ..... 472/95–97, 99, 102; 482/51; 434/247
See application file for complete search history.

(56) References Cited

U.S. PATENT DOCUMENTS

| | | | | |
|---|---|---|---|---|
| 4,988,300 | A * | 1/1991 | Yamaguchi et al. | 434/247 |
| 5,085,425 | A * | 2/1992 | Collins et al. | 472/97 |
| 5,931,739 | A * | 8/1999 | Layer et al. | 472/60 |
| 6,302,497 | B1 * | 10/2001 | Takayama | 303/114.1 |
| 7,736,277 | B2 * | 6/2010 | Nakanishi | 482/51 |
| 7,775,939 | B2 * | 8/2010 | Nakanishi | 482/51 |
| 7,931,565 | B2 * | 4/2011 | Nakano | 482/51 |

* cited by examiner

*Primary Examiner* — Kien Nguyen
(74) *Attorney, Agent, or Firm* — John J. Elnitski, Jr.

(57) ABSTRACT

A ride simulator having a body adapted for a rider, a base to mount the body, a motor to move the body, a pivot shaft to provide a connection between the body and the motor, a drive gear connected to the motor, a pivot gear that engages the drive gear and is rotated due to rotation of the drive gear. A movement assembly having a pivot shaft guide, a gear mount to mount the pivot shaft guide to the pivot gear, a mount bevel gear mounted inside the mount bearing and mounted to the pivot gear and a shaft bevel gear attached to a bottom end of the pivot shaft and engages the mount bevel gear so that the shaft bevel gear is rotated due movement of the mount bevel gear that moves with rotation of the pivot gear.

10 Claims, 9 Drawing Sheets

MECHANICAL RIDE SIMULATOR

This application claims the benefit of and incorporates by reference U.S. Provisional Application No. 61/721,157 filed Nov. 1, 2012.

BACKGROUND

The present invention generally relates to simulators. More specifically, the present invention relates to simulator rides to simulate riding an animal.

Animal ride simulators have existed for decades for entertainment and are found in amusement parks, bars, restaurants, and clubs. The current animal ride simulators have strived to be realistic in the nature animal movements, if the animal had an unwanted rider. The current animal ride simulators have yet to reach the mark of total realism. The current animal ride simulators have a difficult time simulating when an animal will stop and change direction, due to the rate of speed the simulator must move and stop.

It is an object of the present invention to provide a mechanical ride simulator that simulates the natural movements of an animal stopping and changing direction to remove an unwanted rider.

SUMMARY OF THE INVENTION

A ride simulator having a body adapted for a rider, a base to mount the body, a motor to move the body, a pivot shaft to provide a connection between the body and the motor, a drive gear connected to the motor, a pivot gear that engages the drive gear and is rotated due to rotation of the drive gear. A movement assembly having a pivot shaft guide, a gear mount to mount the pivot shaft guide to the pivot gear, a mount bevel gear mounted inside the mount bearing and mounted to the pivot gear and a shaft bevel gear attached to a bottom end of the pivot shaft and engages the mount bevel gear so that the shaft bevel gear is rotated due movement of the mount bevel gear that moves with rotation of the pivot gear.

DETAILED DESCRIPTION

Figure 1:
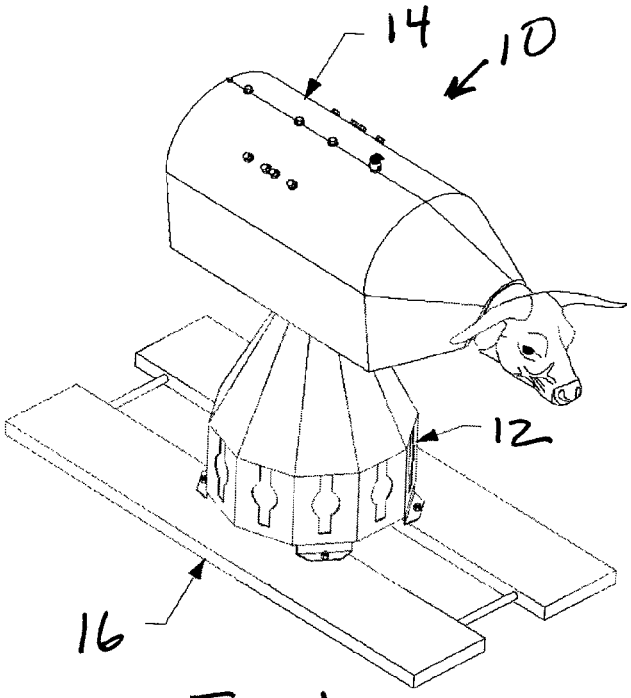
FIG. 1 is a perspective view of a mechanical ride simulator according to the present invention.
Figure 2:
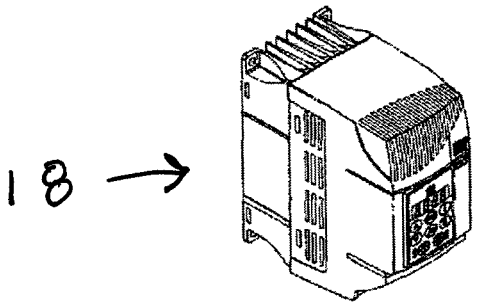
FIG. 2 is a perspective view of a control module according to the present invention.
Figure 3:
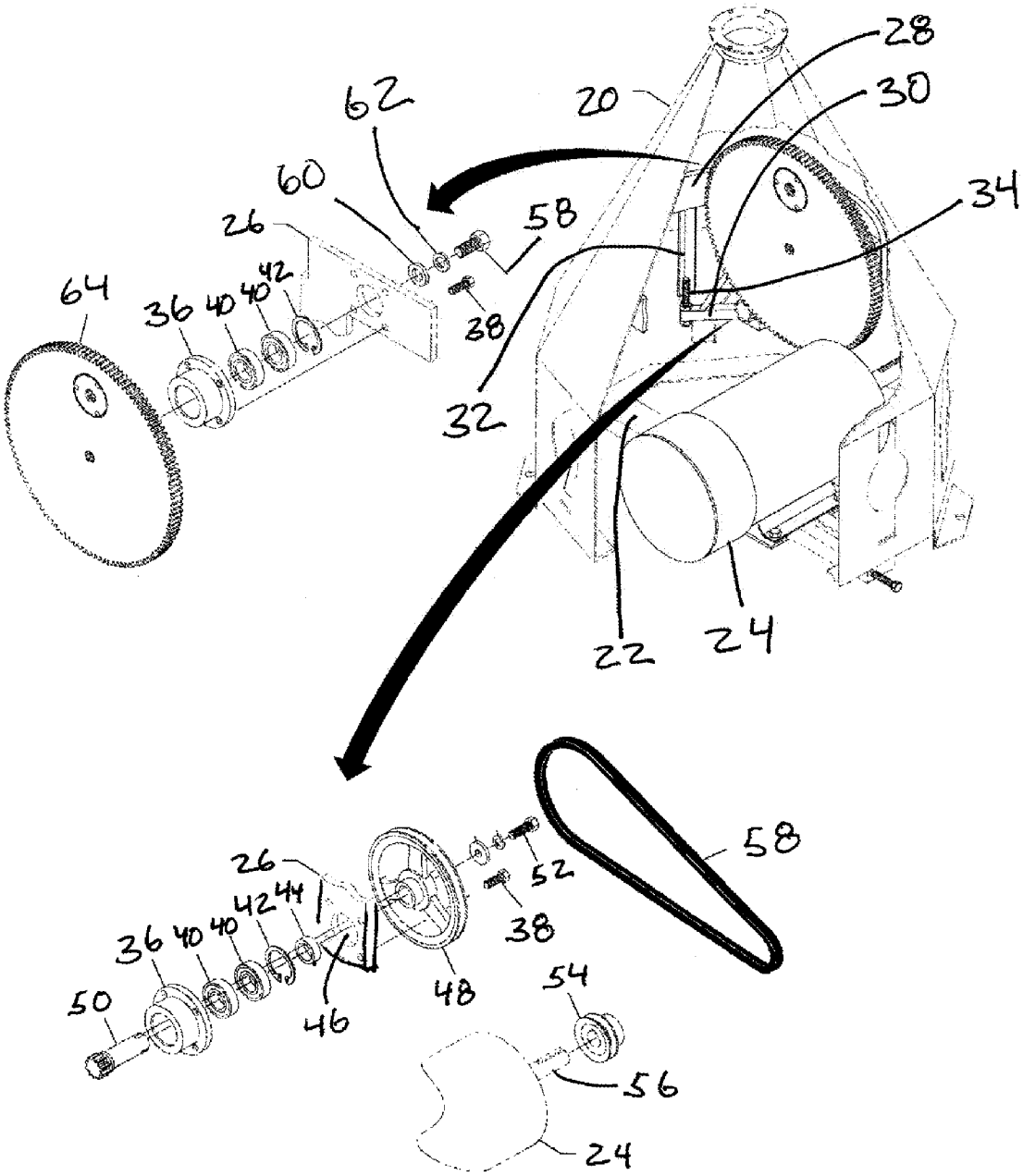
FIG. 3 is a perspective exploded view of a base according to the present invention.

The present invention is a mechanical ride simulator. The simulator as detailed below is particular suited for simulating the behavior of an animal that does not wish to be ridden by a person. FIG. 1 shows the simulator 10 which emulates a bull for bull riding. The simulator 10 includes a base 12 and a body 14 to represent an animal. The base 12 includes a platform 16 mounted to the base 12. The platform 16 supports the base 12 on a surface where the simulator 10 is placed for use. FIG. 2 shows a control module 18 to activate the simulator 10 and control movements of the simulator 10. FIG. 3 shows a cutaway of the base 12. The base 12 includes an outer housing 20 to protect from interaction with the internal components of the simulator 10 that are mounted within the base 12. There is a support framework 22 to support the internal components and the outer housing 20. The outer housing 20 is fastened to the support framework 22.

Figure 4:
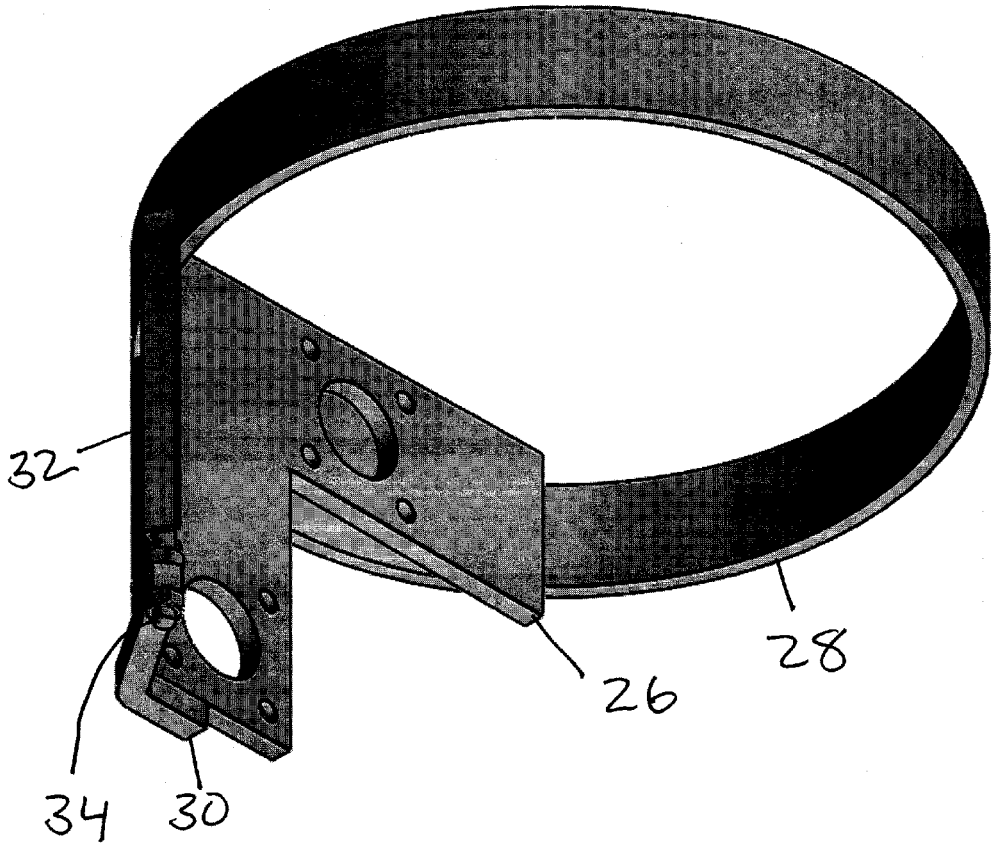
FIG. 4 is a perspective view of a gear mount according to the present invention.

FIG. 3 shows the internal components as a drive gear assembly, pivot gear assembly and motor 24. The drive gear assembly and the pivot gear assembly are attached to a gear mount plate 26. The gear mount plate 26 is shown attached to ring support 28 in FIG. 4. The ring support 28 is part of the support framework 22 as shown in FIG. 3. FIG. 4 shows a horizontal support brace 30, vertical support brace 32 and support bolt 34. The vertical support brace 32 is mounted to the ring support 28. The horizontal support brace 30 is mounted to the gear mount plate 26. The support bolt 34 mounts to the horizontal support brace 30. The interaction of the horizontal support brace 30, vertical support brace 32 and support bolt 34 aids in preventing movement of the gear mount plate 26 due to torque experienced during operation of the simulator 10 from the different components.

The drive gear assembly includes a bearing housing 36 that mounts to one side of the gear mount plate 26 using bolts 38. There are two bearings 40 that mount in the bearing housing 36 and are held in place by a snap ring 42. A spacer 44 is shown for use in the shaft hole 46 of the gear mount plate 26. A drive pulley 48 is mounted on the other side of the gear mount plate 26 and is directly fastened to a drive gear 50 using bolt 52, so that when the drive pulley 48 rotates, the drive gear 50 rotates. The drive gear 50 has ten teeth. FIG. 3 shows a motor pulley 54 that mounts to a motor shaft 56 of the motor 24. FIG. 3 shows a drive belt 58 that attaches between the motor pulley 54 and the drive pulley 48 for rotating the drive pulley 48 and the drive gear 50. The drive pulley 48 is an eight inch pulley and the motor pulley 54 is a three inch pulley, giving the combination a 3 to 8 ratio. The pivot gear assembly includes a bearing housing 36 that mounts to one side the gear mount plate 26 using bolts 38. There are two bearings 40 that mount in the bearing housing 36 and are held in place by a snap ring 42. A gear bolt 58, large heavy washer 60 and lock washer 62 secure a pivot gear 64 to the gear mount plate 26, where the gear bolt 58 acts as a support shaft for the pivot gear 64. The pivot gear 64 has one hundred and sixteen teeth, giving a 1 to 11.6 gear ratio between the drive gear 50 and pivot gear 64.

Figure 5:
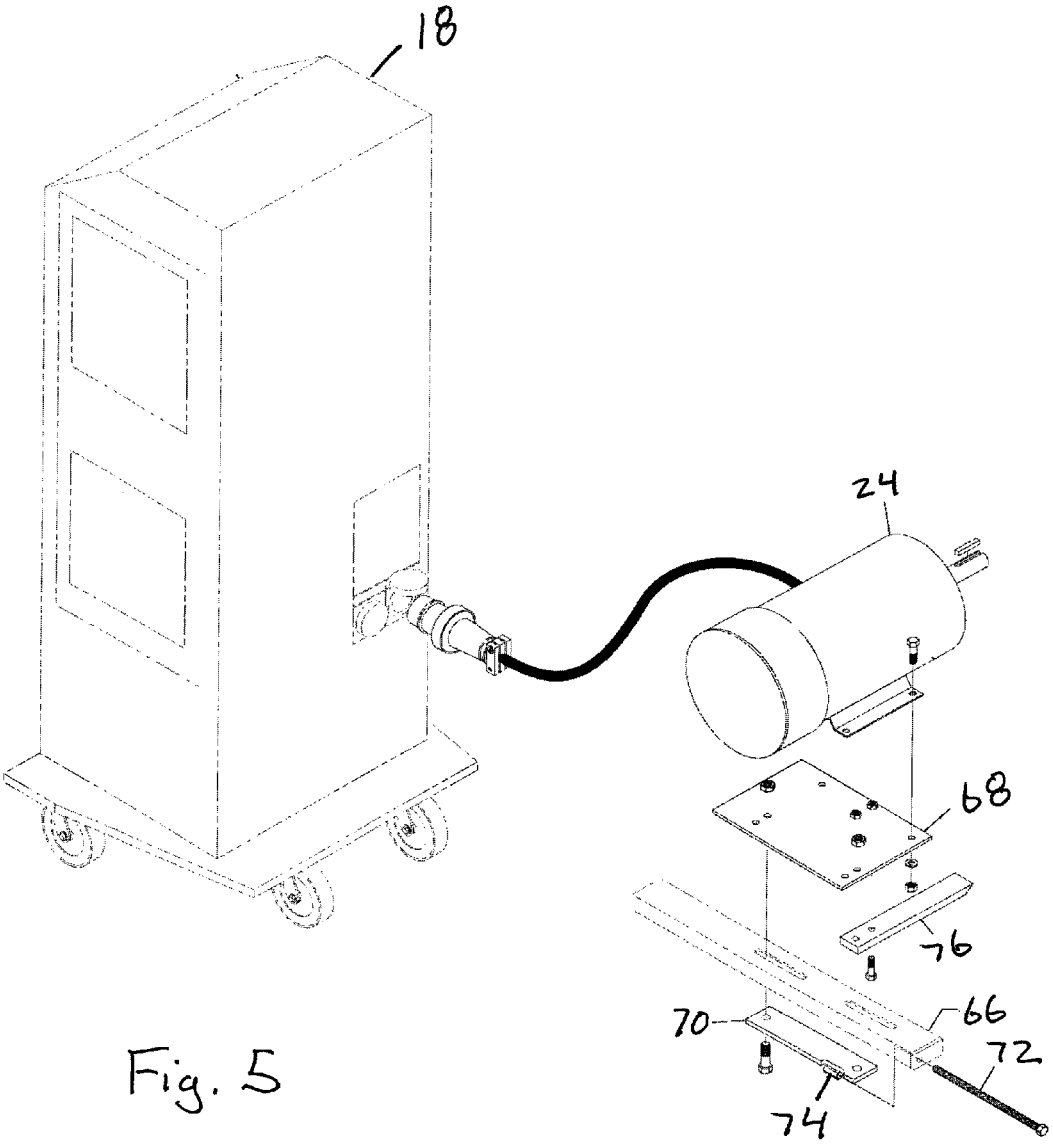
FIG. 5 is a perspective exploded view of a motor and motor mount according to the present invention.

FIG. 5 shows the control module 18 connected to the motor 24 to control the movement of the simulator 10. FIG. 5 also shows a motor support 66 of the support framework 22. The motor 24 mounts to a motor mount plate 68. The motor mount plate 68 is mounted to the motor support 66. A motor adjustment plate 70 is mounted between the motor mount plate 68 and the motor support 66. A long bolt 72 travels through the motor support 66 and into a threaded channel 74 of the motor adjustment plate 68. Movement of the bolt 72 moves the motor mount plate 68 along the motor support 66. Also, a motor brace 76 is included that mounts to the motor mount plate 68 and rests on part of the support framework 22 to provide additional support of the motor 24.

Figure 6:
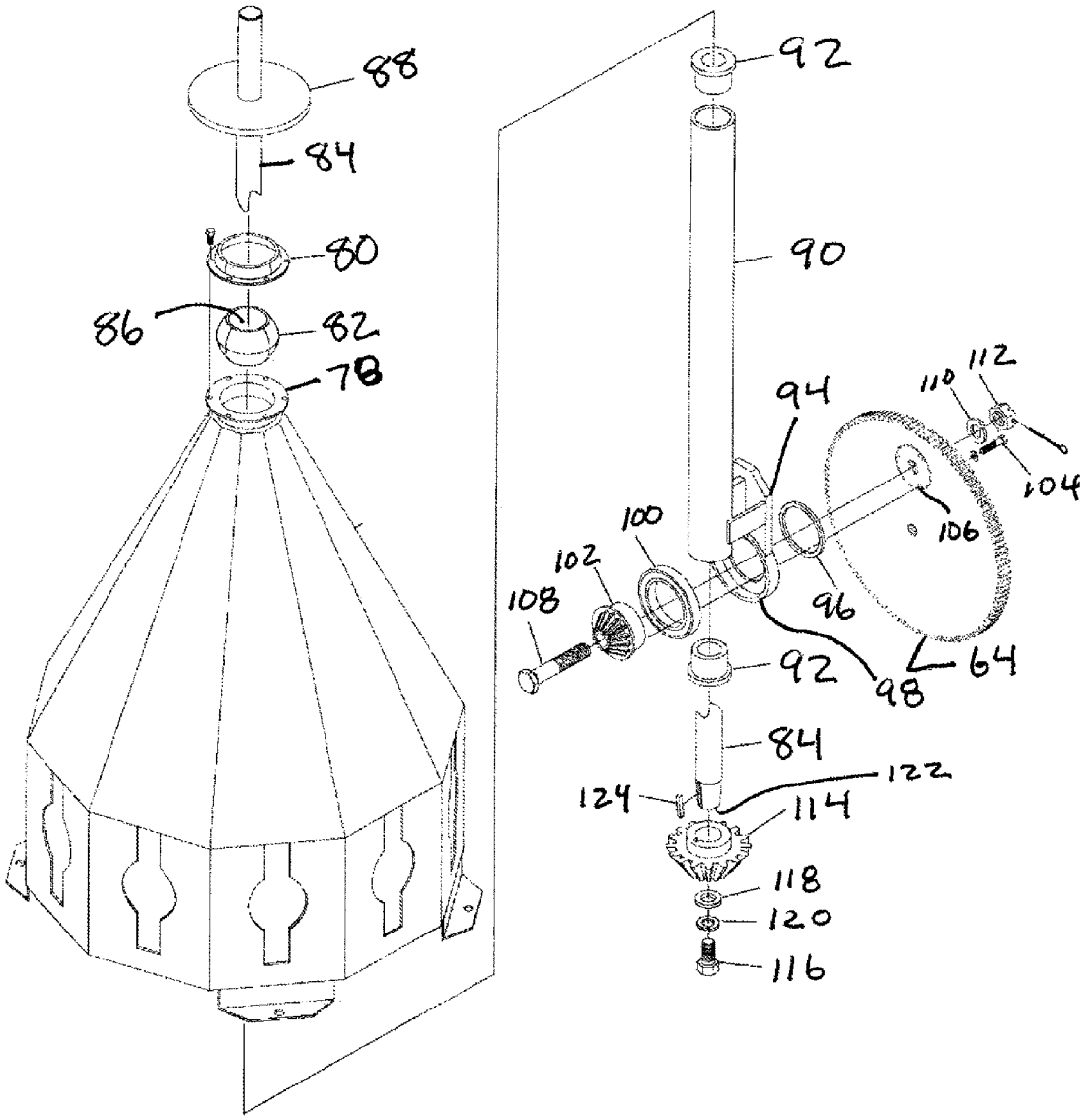
FIG. 6 is a perspective exploded view of a movement assembly according to the present invention.

FIG. 6 shows a support collar 78 and a retention collar 80 mounted to the top of the base 12. The retention collar 80 mounts to the support collar 78 trapping a pivot bearing 82 in place. A pivot shaft 84 mounts through the pivot bearing 82 and enters the base 12. The pivot bearing 82 is typically made from a plastic and is ball shape with a center hole 86 to receive the pivot shaft 84. The ball shape of the pivot bearing 82 allows for the pivot shaft 84 to move around and at angles at the support collar 78. The pivot shaft 84 includes a stop collar 88 to ride above the retention collar 80. The pivot shaft 84 is used to support the body 14 of the simulator 10. FIG. 6 shows additional internal components that are inside the base 12 that make up a movement assembly mounted to the pivot gear 64. The movement assembly includes a tube as a pivot shaft guide 90 to receive the pivot shaft 84. The pivot shaft guide 90 includes two bushings 92 for each end to guide the pivot shaft 84 and keep the pivot shaft 84 centered in the pivot shaft guide 90. The pivot shaft guide 90 includes a gear mount 94 to allow mounting of the pivot shaft guide 90 to the pivot gear 64. A spacer 96 is shown between the gear mount 94 and the pivot gear 64. The gear mount 94 includes a bearing housing 98 to receiver a bearing 100. A mount bevel gear 102 mounts inside the bearing 100. The mount bevel gear 102 has 10 teeth. The mount bevel gear 102 is the attachment point between the gear mount 94 and the pivot gear 64. Bolts 104 are inserted into the pivot gear 64 through holes 106, then threaded into the rear of the mount bevel gear 102. The gear mount 94 rotates about the mount bevel gear 102 using the bearing 100, as the pivot gear 64 turns. A support bolt 108 runs through the center of the mount bevel gear 102 and the pivot gear 64 and is secured by the washer 110 and nut 112. The support bolt 108 provides support for weight that will be placed on the mount bevel gear 102. FIG. 6 shows the pivot shaft 84 extends beyond the pivot shaft guide 90 and is fastened to a shaft bevel gear 114. The shaft bevel gear 114 has 18 teeth, giving a 1 to 1.8 gear ratio between the mount bevel gear 102 and the shaft bevel gear 114. The shaft bevel gear 114 mounts to the pivot shaft 84 using a bolt 116, washer 118 and lock washer 120. The bolt 116 is inserted into the shaft bevel gear 114 and threaded into a gear end 122 of the pivot shaft 84. A square key 124 is used to lock the shaft bevel gear 114 and the pivot shaft 84 together. The shaft bevel gear 114 and the mount bevel gear 102 mesh together to rotate the pivot shaft 84 as the pivot gear 64 rotates and causes the mount bevel gear 102 to rotate. The motor 24 and gearing shown in the base is elliptically based motion instead of just a pivoting motion in order to give the look and ride that the simulator 10 is bucking and kicking in a realistic manner.

Figure 7:
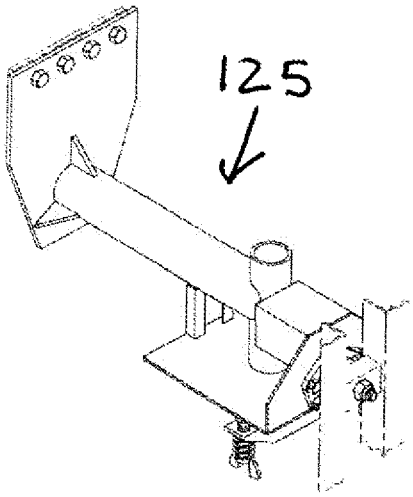
FIG. 7 is a perspective view of an interface assembly according to the present invention.
Figure 8:
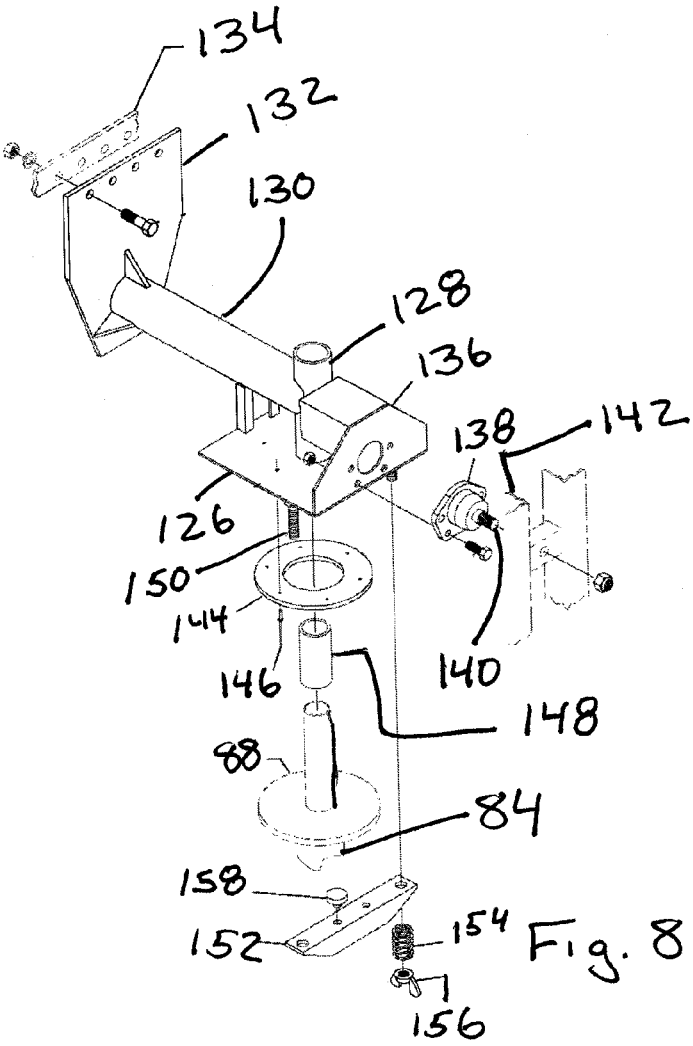
FIG. 8 is a perspective exploded view of an interface assembly according to the present invention.

FIG. 7 shows an interface assembly between the top of the pivot shaft 84 and the body 14 used to simulate an animal. FIG. 8 shows an exploded view of FIG. 7. The interface assembly includes an interface plate 126. Attached to the interface plate 126 is a pivot shaft receiver 128. Extending from the pivot shaft receiver 128 and supported by the interface plate 126 is a cross bar 130. The cross bar 130 includes a body attachment plate 132 for connection to a component 134 of the body 14. The interface plate 126 includes a body support plate 136. The body support plate 136 accepts the mounting of a ball joint assembly 138. The ball joint assembly 138 includes a ball stud 140 extending from the covered ball (not shown). The ball stud 140 attaches to another component 142 of the body 14. The ball joint assembly 138 allows for flexibility between the interface assembly and the body 14. The interface assembly includes a spacer 144 attached with rivets 146 that lies between the interface plate 126 and the stop collar 88 of the pivot shaft 84. The top of the pivot shaft 84 above the stop collar 88 is inserted into the pivot shaft receiver 128. A bushing 148 is used in the pivot shaft receiver 128 between the inside of the pivot shaft receiver 128 and the outside of the pivot shaft 84. The interface plate 126 includes two studs 150 for attachment of a hold down bracket 152 using springs 154 and wing nuts 156. The hold down bracket 152 is mounted against the bottom of the stop collar 88 when mounted to the interface plate 126 to hold the interface assembly to the pivot shaft 84. The hold down bracket 152 includes replaceable wear buttons 158 that contact the stop collar 88. The springs 154 provide for flexibility during movement of the pivot shaft 84 and the interface assembly.

Figure 9:
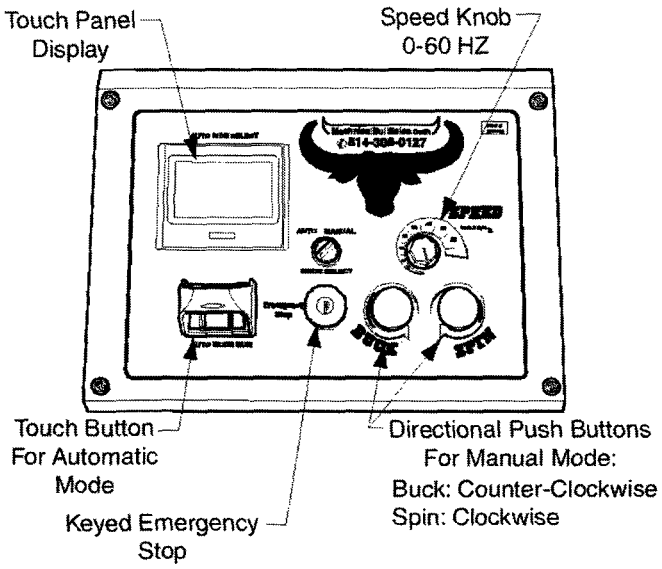
FIG. 9 is a schematic of a control panel according to the present invention.

FIG. 9 shows a schematic of a control panel that connects to the control module 18 of FIGS. 2 and 5. The control panel allows the user to control the speed of movement using a speed knob and direction of using the buck and spin control buttons. The speed and direction controls are used when the simulator is operated manually by a person. The control panel also includes software to allow the simulator to run automatically. The control module includes a variable frequency drive that is an adjustable-speed drive used to control the speed and torque of the motor by varying motor input frequency and voltage using the control panel. The motor 24 is a 230VAC, 3 phase, 60 Hz, 3 HP AC motor. The variable frequency drive is 3 HP. In manual mode the variable frequency drive is controlled by the speed potentiometer of the speed knob and directional pushbuttons for the buck and spin. The variable frequency drive controls motor direction, speed and torque. The motor includes a dynamic brake to provide a faster deceleration rate to the motor for producing faster and more controlled braking. If load inertia energy is greater than the energy delivered to the motor shaft, motor speed decreases. Negative torque is developed in the motor and the motor now acts as a generator converting output shaft mechanical power back to electrical energy. This power is returned to the variable frequency drive DC link element (capacitor or reactor). The simulator includes a braking DC chopper external to the variable frequency drive that transfers the energy to external resistors and dissipates the energy as heat. The control module includes cooling fans to prevent resistor overheating. The combination of the variable frequency drive and the dynamic brake allows for the simulation of stopping and changing direction of an animal.

While different embodiments of the invention have been described in detail herein, it will be appreciated by those skilled in the art that various modifications and alternatives to the embodiments could be developed in light of the overall teachings of the disclosure. Accordingly, the particular arrangements are illustrative only and are not limiting as to the scope of the invention that is to be given the full breadth of any and all equivalents thereof.

I claim:

1. A ride simulator comprising:

a body adapted for a rider;

a base to mount said body;

a motor to move said body, said motor mounted in said base;

a pivot shaft to provide a connection between said body and said motor;

a drive gear connected to said motor such that said motor rotates said drive gear;

a pivot gear that engages said drive gear and is rotated due to rotation of said drive gear; and a movement assembly for connection of said pivot gear to said pivot shaft, said movement assembly comprising:

a pivot shaft guide to receive said pivot shaft a gear mount to mount said pivot shaft guide to said pivot gear, said gear mount including a bearing housing with a mount bearing;

a mount bevel gear mounted inside said mount bearing, said mount bevel gear attached to said pivot gear in a non rotational manner such that said gear mount moves about said mount bevel gear due to said mount bearing; and a shaft bevel gear attached to a bottom end of said pivot shaft that extends beyond said pivot shaft guide and engages said mount bevel gear so that said shaft bevel gear is rotated due movement of said mount bevel gear that moves with rotation of said pivot gear.

2. The ride simulator of claim 1, further including a ball shaped bearing at a top of said base, said ball shaped bearing including a through hole to allow said pivot shaft to pass through said ball shaped bearing.

3. The ride simulator of claim 1, wherein a gear ratio between said drive gear and said pivot gear is 1 to 11.6.

4. The ride simulator of claim 1, wherein said drive gear has 10 teeth and said pivot gear has 116 teeth.

5. The ride simulator of claim 1, wherein a gear ratio between said shaft bevel gear and said mount gear is 1 to 1.8.

6. The ride simulator of claim 1, wherein said shaft bevel gear has 10 teeth and said mount bevel gear has 18 teeth.

7. The ride simulator of claim 1, further including a interface assembly between said pivot shaft and said body, said interface assembly comprising:

an interface plate a pivot shaft receiver attached to said interface plate to receive said pivot shaft;

a cross bar extending from said pivot shaft receiver and supported by said interface plate, said cross bar including a body attachment plate for connection to said body;

a body support plate as part of said interface plate to accept mounting of a ball joint assembly, where said ball joint assembly includes a ball stud extending for attachment to said body;

at least two studs for attachment of a hold down bracket extending from said interface plate;

a hold down bracket mounted against a bottom of a stop collar of said pivot shaft and onto said at least two studs; and a spring between said hold down bracket and a fastener on each of said studs.

8. The ride simulator of claim 1, further including a control module connected to said motor, said control module including a variable frequency drive as an adjustable-speed drive to control speed and torque of said motor by varying motor input frequency and voltage.

9. The ride simulator of claim 1, further including a control module connected to said motor, said control module including a dynamic brake to provide a faster deceleration rate to said motor for producing faster and more controlled braking.

10. The ride simulator of claim 8, wherein said control module includes a dynamic brake to provide a faster deceleration rate to said motor for producing faster and more controlled braking.

* * * * *